US005682785A

United States Patent [19]

Müller et al.

[11] Patent Number: 5,682,785

[45] Date of Patent: Nov. 4, 1997

[54] ROLLING MILL AND METHOD FOR PRECISION ROLLING WIRE OR ROLLING STOCK HAVING A ROUND CROSS-SECTION

[75] Inventors: Hubert Müller, Grevenbroich; Karl Keller, Hilchenbach; Paul Josef Mauk, Düsseldorf, all of Germany

[73] Assignee: SMS Schloemann-Siemag, Dusseldorf, Germany

[21] Appl. No.: 654,813

[22] Filed: May 29, 1996

Related U.S. Application Data

[63] Continuation of Ser. No. 27,302, Mar. 5, 1993, abandoned.

[30] Foreign Application Priority Data

Mar. 7, 1992 [DE] Germany ..... 42 07 298.0

[51] Int. Cl.[6] ..... B21B 13/08; B21B 31/07

[52] U.S. Cl. ..... 72/234; 72/249

[58] Field of Search ..... 72/234, 235, 249, 72/239

[56] References Cited

U.S. PATENT DOCUMENTS

| | | | |
|---|---|---|---|
| 3,992,915 | 11/1976 | Hermes et al. | 72/249 |
| 4,527,408 | 7/1985 | Jalil | 72/201 |
| 4,907,438 | 3/1990 | Sasaki et al. | 72/235 |
| 5,050,418 | 9/1991 | Grotepass | 72/239 |

FOREIGN PATENT DOCUMENTS

| | | | |
|---|---|---|---|
| 0152302 | 8/1985 | Japan | 72/234 |
| 0043702 | 2/1988 | Japan | 72/234 |
| 216280 | 6/1986 | United Kingdom | 72/234 |

*Primary Examiner*—Lowell A. Larson
*Assistant Examiner*—Rodney Butlz
*Attorney, Agent, or Firm*—Anderson Kill & Olick, P.C.

[57] ABSTRACT

A roll mill and method for rolling wires or rolling stock having a round cross-section and made from high grade steel or other alloyed steel in a high production-light section/wire mill is disclosed. By the invention, the tightest wire tolerances to roll the rolling stock in a temper roll block of the roll mill with a distinctly lower pass reduction compared to the reduction passes performed in the finishing roll block of the wire mill is achieved. The wire mill comprises a breakdown train comprising respectively several roll stands or roll units, at least one intermediate train with adjoining or subsequent finishing train, wherein the finishing train is, in particular, configured as the finishing roll block. A temper roll block, comprising at least two stands is disposed downstream of the finishing roll block, and a cooling path 13 and/or a temperature compensation device 14 is, if needed, disposed between the finishing roll block and the temper roll block. In order to be able to utilize the temper roll block as a precision roll block, the temper roll block is provided with a shifting gear box for shifting same to a reroll or precision rolling operation.

2 Claims, 1 Drawing Sheet

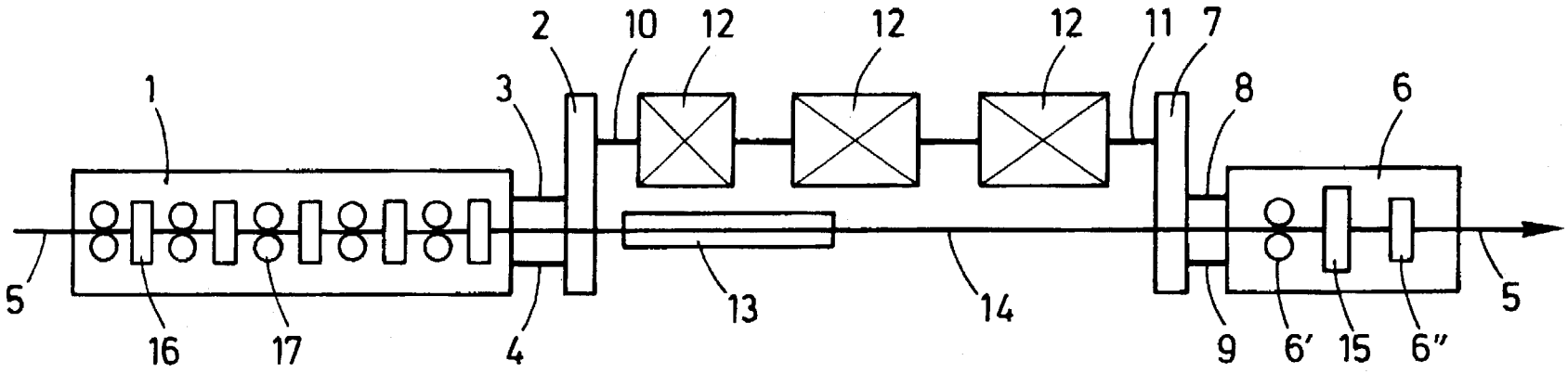
5
6
6''
15
6'
8
9
7
11
12
12
12
14
13
10
2
3
4
17
1
16
5

ROLLING MILL AND METHOD FOR PRECISION ROLLING WIRE OR ROLLING STOCK HAVING A ROUND CROSS-SECTION

This is a continuation of application Ser. No. 08/027,302, filed Mar. 5, 1993, abandoned.

The present invention deals with a method for rolling wire or rolling stock having a round cross-section and made from high grade steel or other alloyed steels in a high production light section/wire mill.

BACKGROUND OF THE INVENTION

Modern high capacity light section/wire mills consist mostly of a break-down train downstream of the furnace installation, one or several intermediate trains and a finishing roll block for the rolling stock. The roll stands in the break-down mill and the intermediate mill are of rugged construction and designed for high rolling loads. In the break-down train, individual stands are generally used.

In the intermediate train, preferably package-type stands with a horizontal/vertical arrangement of the rolls are used. By the term finishing roll block, one means a roll train comprising several, mostly six to ten roll units, alternately offset through 90° against each other, arranged in the line of rolling closely one behind the other in a case or housing, and which can be driven either directly or in common as roll units by a drive through a transfer of distribution gear box.

A water cooling path or segments with an integrated temperature compensation device for the rolling stock follows upon the finishing roll block. Depending upon the dimensions and the quality of the rolling stock, the cooling zones can be configured or controlled in such a way, that the required temperature profile in the rolling stock is achieved also at the maximum rolling speed. The rolling stock is air-cooled, for instance, in a Stelmor installation after the water cooling path. At the end of the Stelmor installation, an adjustable drop stage with an adjoining chain conveyor is disposed. The wire windings are transported to a coil formation chamber by the chain conveyor. The finished coils are placed by an upender upon a hook conveyor for wire coils and travel from there into a banding station and then to shipping.

It is proposed, to increase the output capacity of existing light section/wire mills in particular, which possibly are already operated in technically limited conditions, by adding an additional temper block comprising at least two stands and to be disposed downstream of the finishing roll block, wherein a temper and cooling and/or compensation or soaking device for the rolling stock is interposed between the finishing roll block and the temper roll block. The overall pass reduction of existing roll mills can be increased by this measure and smaller finished dimensions of the rolling stock can be achieved. The end rolling speed can also be increased with the speed level of the mill remaining unchanged. Furthermore, the texture of rolling stock can be affected by targeted cooling upstream of the last two passes in the temper roll block.

The roll mills described above however do not always assure the closest wire tolerances at a high output level of the mill.

It is therefore an object of the present invention to improve the roll mill of the above-mentioned type, in order to obtain the closest wire tolerances at a high output level of the mill.

Another object of the invention is to provide a roll mill and method for rolling a wire or rolling stock having a round cross-section and made from high grade steel or other alloyed steels in a high performance light section/wire mill.

SUMMARY OF THE INVENTION

These and other objects of the invention, which shall become hereafter apparent, are achieved by providing a roll mill and a method for precision rolling a wire or rolling stock having a round cross-section, which insure that the stock is rolled in the temper roll block designed for stock temper rolling which, as known, is a cold rolling operation (see *The Making, Shaping and Treating of Steel*, United States Steel, 1971. )

The temper rolling of the stock is effected with a pass reduction which is distinctly less than that of the pass reductions performed in the finishing roll block. The temper roll block is thus used as a precision roll block, in order to improve the surface quality of the rolling stock and further to tighten the rolling stock tolerances. In connection with the achievable temperature control of the rolling stock in the cooling and soaking or compensation pass, the rolling stock properties and the surface of the rolling stock can be rapidly and securely adapted, within a wide range, to the respective product requirements, prior to the precision rolling process.

The desired results are achieved by a method for rolling wire or rolling stock having a round cross-section and made from high grade steel or other alloyed steels in a high performance light section/wire mill with a break-down train comprising several roll stands or roll units, at least one intermediate train with a finishing train following thereafter, such as a finishing roll block, wherein a temper roll block comprising at least two stands, is disposed downstream of the finish roll block, with a cooling path and/or a temperature equalization device being, if necessary, arranged between the finishing roll block and the temper roll block. The invention also relates to a roll mill for performing this rolling process.

It is desirable particularly in a two stand temper roll block, that the rolling stock be rolled in the final stand of the temper roll block with a pass reduction which provides for a further reduction of the diameter of the rolling stock obtained in the preceding stand of the temper roll block. It has been found to be appropriate that the pass reduction in the outlet stand amounts to approximately 5 to 15% of the rolling stock diameter obtained in the preceding block.

The roll mill for performing the rolling method in the invention, for a wire or rolling stock having a round cross-section, is distinguished by providing a shifting gear box for the temper roll block for shifting the operation of the temper block to a reroll or a precision rolling operation. Shifting gear boxes in the hitherto usual arrangement of roll mills for reducing the reduction relationships are possibly known as such. This however has nothing to do with the measure being discussed here since the utilization of a temper roll block, downstream of the finishing roll block in a roll mill, was unknown. For enrichment of the known roll mill technology, the shifting of the temper roll block or specific stand housings of the temper roll block proposed here enables the achievement of the closest rolling stock tolerances and the adaptation of, especially, existing roll mills to a wide group of products.

The shifting gear box can be disposed upstream of the temper roll block in an advantageous refinement of the roll mill. It is however also appropriate to dispose the shifting gear box between the individual stands of the temper roll block, preferably upstream of its outlet stand. Because a rolling stock reduction of, for example, 5% to 15% occurs in the temper roll block switched over to a precision rolling operation, the gearing transmission ratio of the switching gear box is laid out in a range of 1:1.25 to 1:1.15. The pass design of the rolls of the temper roll block is selected for a precision rolling operation.

BRIEF DESCRIPTION OF THE DRAWING

The single FIGURE of the drawings shows a schematic view of a roll mill with a finishing roll block, a cooling temperature compensation device, and a temper roll block switchable to a precision rolling operation.

DETAILED DESCRIPTION OF THE PREFERRED EMBODIMENT

The typical light section/wire mill comprises a preheating chamber where the bloom to be rolled (mostly a billet or wire bar) is preheated, prior to heating it to rolling temperature in a gravity discharge furnace. The billet received from the gravity discharge furnace goes after a pressurized water descaling, into a break-down mill, comprising several stands, where the billet or wire bar cross-section is reduced to a round cross-section. Usually a flying, cropping or chopping shears is disposed downstream of the break-down train, which is able to prepare a cropped end for the intermediate train. The rolling string passes through the intermediate train, where the cross-section of the round rolled stock is further reduced in several passes. Subsequently, the rolling string, after having its rolled ends cropped again, is transferred into a finishing roll block 1, shown diagrammatically in the FIGURE.

This finishing roll block 1, comprises ten twist-free stand housings in a 45° arrangement. The horizontal stand housings 16 have been drawn perpendicularly to the rolling string 5 in the diagrammatic plan view and have been emphasized by thickened lines. The vertical stand cases or housings 17 are shown as roll barrels located one opposite the other. The finishing roll block 1 is connected to a transfer of distributor gear box 2, from which one drive shaft 3 leads towards the horizontal stand housings and another output drive shaft 4 leads to the vertical stand housings.

The depicted view of the light section/wire train shows, in addition, a two-stand temper roll block 6, wherein the vertical stand housing 6' and the horizontal stand housing 6" are disposed at an angle of 90° to one another. The finishing roll block 1 and the temper roll block 6 are aligned along the rolling line. The temper roll block 6 is connected to a shifting gear box 7, of which one power output shaft 8 leads to the horizontal stand housing and another power output shaft 9 leads to the vertical stand housing. The input shaft 5, 10, 11 of the transfer gear box 2 or of the shifting gear box 7 are directly coupled with three D.C. motors 12 of equal power. The D.C. motors serve for driving the finishing roll block and for driving the temper roll block. Between the transfer gear box 2 and the shifting gear box 7, a water chamber 13 for cooling the rolling stock and a compensation path 14 for temperature compensation of the rolling stock are provided.

The temper roll block 6 has a reversing gear box 15 between the vertical stand housing 6' and the horizontal stand housing 6", in order to be able to utilize the temper roll block as a precision roll block, if necessary, the transmission ratio of the reversing gear box 15 is approximately 1:1.25 to 1:1.15. If the temper roll block is also to be used as a precision roll block, the pass design of the rolls of the outlet stand or of the stand housing 6" is matched to the preset precision rolling.

An additional water cooling path, as well as a Stelmor installation, is possibly arranged downstream of the temper roll block (this has not been depicted in detail) as well as the coil forming chamber and a hook conveyor for wire coils for the wire coils prepared for shipping.

The pre-rolled cropped wire from the intermediate train, which is not shown, enters the finishing roll block 1 and is reduced in its ten stand housings twist free to, for instance, 5.5 mm diameter at a final rolling speed of approximately 85 m/sec. Subsequently, the wire is passed through the water chamber 13, cooled therein and then passed through the temperature compensation path 14. The regulation of the temperature cooling and of the temperature compensation is performed as a function of the respective wire alloy and the desired quality profile. If necessary, a cooling/compensation arrangement of the finishing roll block 1 can be added. Subsequently, the wire arrives into the temper roll block 6 and is rolled, to begin with, in the first vertical stand housing in one standard pass to 5 mm diameter. After that, it enters the horizontal stand housing 6" and is rolled, in this exit stand, with a pass reduction resulting in a further wire diameter reduction of approximately 5 to 15%. With appropriately adapted or matched sizing of the roll barrels in the outlet stand 6" of the temper roll block wire, tolerances are achieved in this way with the high output level of the roll mill remaining unchanged.

The roll mill of the type defined here becomes even more adaptable to the different rolling stock products and rolling stock qualities because of the inventive shifting switching of the temper roll block to a precision rolling operation.

While the preferred embodiment of the invention has been disclosed, in detail, modifications and adaptations may be made thereto, with departing from the spirit and scope of the invention, as delineated in the following claims:

What is claimed is:

1. A method of rolling one of a wire and rolling stock having a round cross-section and made from a high grade steel in a high performance light section/wire train, including a break-down train with a plurality of roll stands, at least one intermediate train, and a finishing roll block, said method comprising the steps of:

providing cooling means downstream of the finishing train;

providing, downstream of the cooling means, a temper roll block having an inlet roll stand, an outlet roll stand, and a reversing gear box disposed between the inlet roll stand and the outlet roll stand for shifting an operation of said temper roll block between temper rolling and precision rolling;

cooling the one of a wire and rolling stock in the cooling means; and rolling the one of a wire and rolling stock in the temper roll block so that a diameter of the one of a wire and rolling stock is further reduced in both roll stands of the temper roll block, wherein the pass reduction in the outlet roll stand of the temper roll block is from about 5% to 15% of a diameter obtained in the inlet roll stand of the temper roll block.

2. A roll mill assembly for rolling one of a wire and rolling stock having a round cross-section and made from high grade steel in a high performance light section wire train including a break-down train with a plurality of roll stands, at lease one intermediate train, said roll mill assembly comprising:

a finishing roll block;

cooling means disposed downstream of the finishing block; and a temper roll block, having inlet and outlet rolls stands and disposed downstream of the cooling means, said temper roll block including a reversing gear box disposed between the inlet and outlet roll stands for shifting an operation of said temper roll block between temper rolling and precision rolling, said shifting gear box having a transmission gear ratio in a range of 1:1.25 to 1:1.15.

* * * * *